US006253570B1

(12) United States Patent
Lustig

(10) Patent No.: US 6,253,570 B1
(45) Date of Patent: Jul. 3, 2001

(54) TRAVELING BAG WITH EXTERIOR DISPLAY OF INTERIOR TEMPERATURE

(76) Inventor: Harold Lustig, 16990 Hinton Ct., Castro Valley, CA (US) 94546

( * ) Notice: Subject to any disclaimer, the term of this patent is extended or adjusted under 35 U.S.C. 154(b) by 0 days.

(21) Appl. No.: 09/585,095

(22) Filed: Jun. 1, 2000

(51) Int. Cl.[7] ..... F25D 3/08

(52) U.S. Cl. ..... 62/457.2; 62/371; 62/125

(58) Field of Search ..... 62/457.2, 371, 62/125, 129; 165/11.1; 236/94; 206/438, 570

(56) References Cited

U.S. PATENT DOCUMENTS

| | | | |
|---|---|---|---|
| 3,148,515 | 9/1964 | Jentis et al. . | |
| 4,250,998 | 2/1981 | Taylor . | |
| 4,322,954 | 4/1982 | Sheehan et al. . | |
| 4,343,158 | 8/1982 | Campbell . | |
| 4,429,793 | 2/1984 | Ehmann . | |
| 4,573,581 | 3/1986 | Galloway et al. . | |
| 4,738,364 | 4/1988 | Yeager . | |
| 4,955,480 | 9/1990 | Sexton . | |
| 5,161,606 * | 11/1992 | Berkeley et al. | 165/1 |
| 5,390,791 | 2/1995 | Yeager . | |
| 5,400,610 * | 3/1995 | Macedo | 62/130 |
| 5,490,396 * | 2/1996 | Morris | 62/457.2 |
| 5,865,314 * | 2/1999 | Jacober | 206/570 |

* cited by examiner

*Primary Examiner*—Michael Powell Buiz
*Assistant Examiner*—Melvin Jones
(74) *Attorney, Agent, or Firm*—Edward Gray

(57) ABSTRACT

A traveling bag for carrying temperature-sensitive medications such as insulin which includes a sensor monitoring the interior temperature and an exterior display showing the measured temperature. In one embodiment the bag interior includes a compartment for storing medication, an assembly for securely holding three insulin pens, and a compartment for holding a container of freezing material. A second embodiment of the bag omits the freezing material compartment.

6 Claims, 6 Drawing Sheets

TRAVELING BAG WITH EXTERIOR DISPLAY OF INTERIOR TEMPERATURE

BACKGROUND OF THE INVENTION

1. Field of the Invention

This invention relates to a traveling bag for carrying temperature-sensitive medications such as insulin, and more particularly to a bag which includes a sensor to monitor the interior temperature which is continuously displayed on an exterior gauge.

2. Description of the Related Art

Diabetics and other persons under medical treatment often are required to take injections to forestall unconsciousness or other ill effects. In many cases the medication must be stored at a temperature considerably lower than the ambient temperature. Patients who remain at home or whose job responsibilities never require them to travel can store their medications in a refrigerator. For business people who must travel and vacationers, the ability to travel freely often is greatly constrained because they must always keep medications with them to allow proper time-phased administration of dosage, and can find themselves unavoidably in a hot climate where a medication can be spoiled by overheating. Insulin is particularly susceptible to deterioration and must be maintained at a temperature between 38° F. and 84° F. Other commonly prescribed medications which are temperature unstable are glyceryltrinitrate, benzodiazepines, prochlorperazine, penicillin, pseudoephedrine, promethazine, prednisolone and captopril.

Bags, cases, coolers and pouches for carrying temperature-sensitive medications, particularly insulin, are described in the related art. U.S. Pat. No. 3,148,515 to R. Jentis et al. discloses an insulin travel kit which includes a bimetallic thermostatic element which controls the discharge of liquid refrigerant from a supply bottle into a heat-exchange coil encircling an insulin bottle wherein the refrigerant is evaporated and from which the resultant gas is discharged into the air. The element is contiguous to the coil. Whenever the temperature measured by the element rises above 40° F., the element curls so as press against the hook of a valve stem, rocking a throttle valve member on its seat until refrigerant is released. When the temperature goes back down to 40° F., the element bends in the reverse direction, permitting the throttle valve member to rock back into closed position. These reverse temperature regulating actions occur repeatedly and automatically.

U.S. Pat. No. 4,250,998 to F. Taylor discloses a travel kit having thermally insulated peripheral and bottom walls determining a cavity sized to receive an inner container. The container and a top lid determine an annular chamber which is filled almost full with water which is then frozen into an annular ring of ice surrounding a compartment in the container upper portion. An insulin bottle within the compartment remains cold because, in addition to its being thermally insulated, as the frozen water melts, ice remains afloat and in thermal contact with the compartment outer wall.

U.S. Pat. No. 4,322,954 to L. M. Sheehan et al. discloses a portable cooler consisting largely of insulative foam material for transporting medications which must be kept at lower than ambient temperature. The cooler includes an ice compartment and a medicine compartment. Each compartment contains a metallic heat sink. The sinks are thermally and mechanically connected by a heat tube, i.e., a sealed container containing a substance having a well-defined boiling point which may depend on the pressure within the tube. When the tube lower end is colder than the boiling point, the substance collects at the lower end in liquid form. If the temperature at the lower end thereafter increases to the boiling point, the substance begins to boil and heat is absorbed as some of the substance is converted into a gas. The gas carries the heat to the tube upper end where the heat is released as the gas condenses back into a liquid which trickles down the walls of the tube to collect again at the lower end. The tube thus provides a one-way path for heat transfer from the medicine compartment to the ice compartment, and acts as a thermostat to limit the temperature of the medicine compartment.

U.S. Pat. No. 4,343,158 to J. H. Campbell discloses a flexible, insulated open-mouth pouch having a pair of opposed walls joined to form a bottom, and a water-repellent liner. Each wall has a layer of insulating material sandwiched between two outer and inner wall layers. The liner includes front and rear partitions bounding a central pocket for holding a refrigerant. The front partition forms together with the liner front wall a compartment for holding a vial of insulin, and the rear partition forms together with the liner rear wall a compartment for holding a hypodermic syringe.

U.S. Pat. No. 4,429,793 to E. G. Ehmann discloses a pocket-sized traveling case for storing insulin. The case includes thermally insulated front and back covers pivotally attached to each other by a central binder, and is opened and closed by a zipper. The inside of the back cover is provided with nn elastic upper strap stitched to form a pair of loops, each of which receives an insulin bottle, and an elastic lower strap which holds a container of freezing material, such as "Blue Ice."

U.S. Pat. No. 4,573,581 to H. R. Galloway et al. discloses a container for protecting medications in the form of tablets from heat and light. The container is internally insulated by a multi-layer reflecting shield including two aluminum foil layers and an expanded polystyrene layer. A tube containing the tablets is surrounded by a heat sink made from a synthetic resin which does not absorb the vapor phase of the contained medication.

U.S. Pat. No. 4,738,364 to S. Yeager discloses a portable medicine protector including a hollow walled container having a cavity filled with a suitable liquid (e.g., water or Blue Ice) which may be frozen in a household freezer. A depression or cavity formed in the container receives medicine such as bottles of liquid. To inhibit freezing of the medicine, the bottom and sides of the cavity have ribbed members which prevent direct contact between a medicine bottle and the side walls of the container.

U.S. Pat. No. 4,955,480 to W. C. Sexton discloses an insulated carrier for-transporting insulin or other medications subject to rapid deterioration or degradation when exposed to ambient temperature conditions. The carrier includes a central block of expanded polystyrene foam, shaped as a rectangular parallelepiped, which has a cylindrical vertical bore. A polystyrene lid is hingedly attached to the block top and a polystyrene base block is secured to the base bottom. A vial of medication is inserted into a plastic vial with a removable lid which is inserted into the bore. The plastic vial rests on a hollow ball which contains a refreezable liquid, such as water, or a degraded collagen matrix containing thermal and chemical stabilizers.

U.S. Pat. No. 5,390,791 to S. Yeager discloses a portable medicine carrier for transporting medications stored in vials. The carrier is filled with a liquid that freezes at a temperature that is approximately equal to the desired storage temperature of the medication. Formed in the top surface of the carrier is a cavity which accepts vials of medication. Within the cavity are compartments of various sizes so as to accommodate a variety of vial shapes and sizes. The carrier is placed in a freezer to allow the liquid to freeze. The vials are then placed within appropriate compartments. The side walls of the cavity include ribbed members transverse to the width of the carrier which prevent vials from contacting the side walls.

Although these references address the need for a portable medication carrier, none provides means to monitor and display the temperature within the carrier, so that a user can be assured that the medication has remained sufficiently cold and also be apprised in time to take appropriate measures should the temperature exceed the acceptable limit.

OBJECTS OF THE INVENTION

Accordingly, it is an object of the present invention to provide a traveling bag which provides an exteriorly visible display of its interior temperature.

Another object of the invention is to provide a traveling bag which can keep temperature-sensitive medications or other materials well below ambient temperature.

Still another object of the invention is to provide a thermally insulated bag which is inexpensive to manufacture.

Other objects of the invention will become evident when the following description is considered with the accompanying drawing figures. In the figures and description, numerals indicate the various features of the invention, like numerals referring to like features throughout both the drawings and description.

SUMMARY OF THE INVENTION

These and other objects are achieved by the present invention which in one aspect provides a traveling bag including a case having a thermally insulated front portion with a front side having an exterior surface, a thermally insulated back portion, and a thermally insulated central portion pivotally attached to the front and back portions so that they are pivotal relative to each other between a closed position in which they are generally parallel, and an open position in which they are pivoted away from each other. The case is closable when the front and back portions are in the closed position by closing a zipper. When closed the case determines a thermally insulated cavity. The bag further includes a pouch having a front portion, with an exterior surface, attached to a circumferential frame portion having a circumferential edge attached to the exterior surface of the case front side. The bag further includes means for measuring the temperature within the cavity, and means for displaying the measured temperature at a preselected exterior portion of the bag.

In another aspect the invention provides a traveling bag which includes a rectangular case including a thermally insulated front portion having a front side, with planar exterior and interior surfaces, attached to a first U-shaped frame portion. The case further includes a thermally insulated back portion having a back side, with a planar interior surface, attached to a second U-shaped frame portion. The case further includes a thermally insulated central portion, with a planar interior surface, pivotally attached to the first and second frame portions so that they are pivotal relative to each other between a closed position in which they are generally parallel, and an open position in which they are pivoted away from each other. The case is closable when the front and back portions are in the closed position by closing a zipper mutually attached to the first and second frame portions. When closed the case determines a thermally insulated cavity. The bag further includes a pouch having a front portion, with an exterior surface, attached to a circumferential frame portion having a circumferential edge attached to the exterior surface of the case front side. The exterior surface of the pouch front portion has a rectangular cutout wherein is disposed a liquid crystal display of a temperature gauge disposed within the pouch. The bag further includes a temperature-sensing element rigidly mounted on the upper surface of a base of thermally insulative material attached to the interior surface of the central portion. The element is in electrical communication with the temperature gauge. The bag further includes an expandable compartment determined by a rectangular wall having three edges attached to the interior surface of the case front side and a fourth unattached edge bounding a closable opening. The bag further includes an assembly including an elasticized strap attached along parallel lines to the interior surface of the case front side so as to determine a plurality of open-ended receptacles, and a rectangular shield having three edges attached to the interior surface of the case front side and a fourth unattached edge bounding an opening proximate and parallel to the receptacles. The bag further includes a compartment for receiving a container of freezing material determined by a rectangular wall attached along four edges to the interior surface of the case back side. The compartment is accessible by opening a zipper in the wall.

In still another aspect the invention provides a traveling bag which includes a rectangular case including a thermally insulated front portion having a front side, with planar exterior and interior surfaces, attached to a first U-shaped frame portion. The case further includes a thermally insulated back portion having a back side, with a planar interior surface, attached to a second U-shaped frame portion. The case further includes a thermally insulated central portion, with a planar interior surface, pivotally attached to the first and second frame portions so that they are pivotal relative to each other between a closed position in which they are generally parallel, and an open position in which they are pivoted away from each other. The case is closable when the front and back portions are in the closed position by closing a zipper mutually attached to the first and second frame portions. When closed the case determines a thermally insulated cavity. The bag further includes a pouch having a front portion, with an exterior surface, attached to a circumferential frame portion having a circumferential edge attached to the exterior surface of the case front side. The exterior surface of the pouch front portion has a rectangular cutout wherein is disposed a liquid crystal display of a temperature gauge, switchable between the Fahrenheit and Celsius scales, disposed within the pouch. The bag further includes a temperature-sensing element rigidly mounted on the upper surface of a base of thermally insulative material attached to the interior surface of the central portion. The element is in electrical communication with the temperature gauge. The bag further includes an expandable compartment determined by a rectangular wall having three edges attached to the interior surface of the case front side and a fourth unattached edge bounding a closable opening. The bag further includes an assembly including an elasticized strap attached along parallel lines to the interior surface of the case front side so as to determine a plurality of open-ended receptacles, and a rectangular shield having three edges attached to the interior surface of the case front side and a fourth unattached edge bounding an opening proximate and parallel to the receptacles.

A more complete understanding of the present invention and other objects, aspects and advantages thereof will be gained from a consideration of the following description of the preferred embodiment read in conjunction with the accompanying drawings provided herein.

DETAILED DESCRIPTION OF THE PREFERRED EMBODIMENTS

Figure 1:
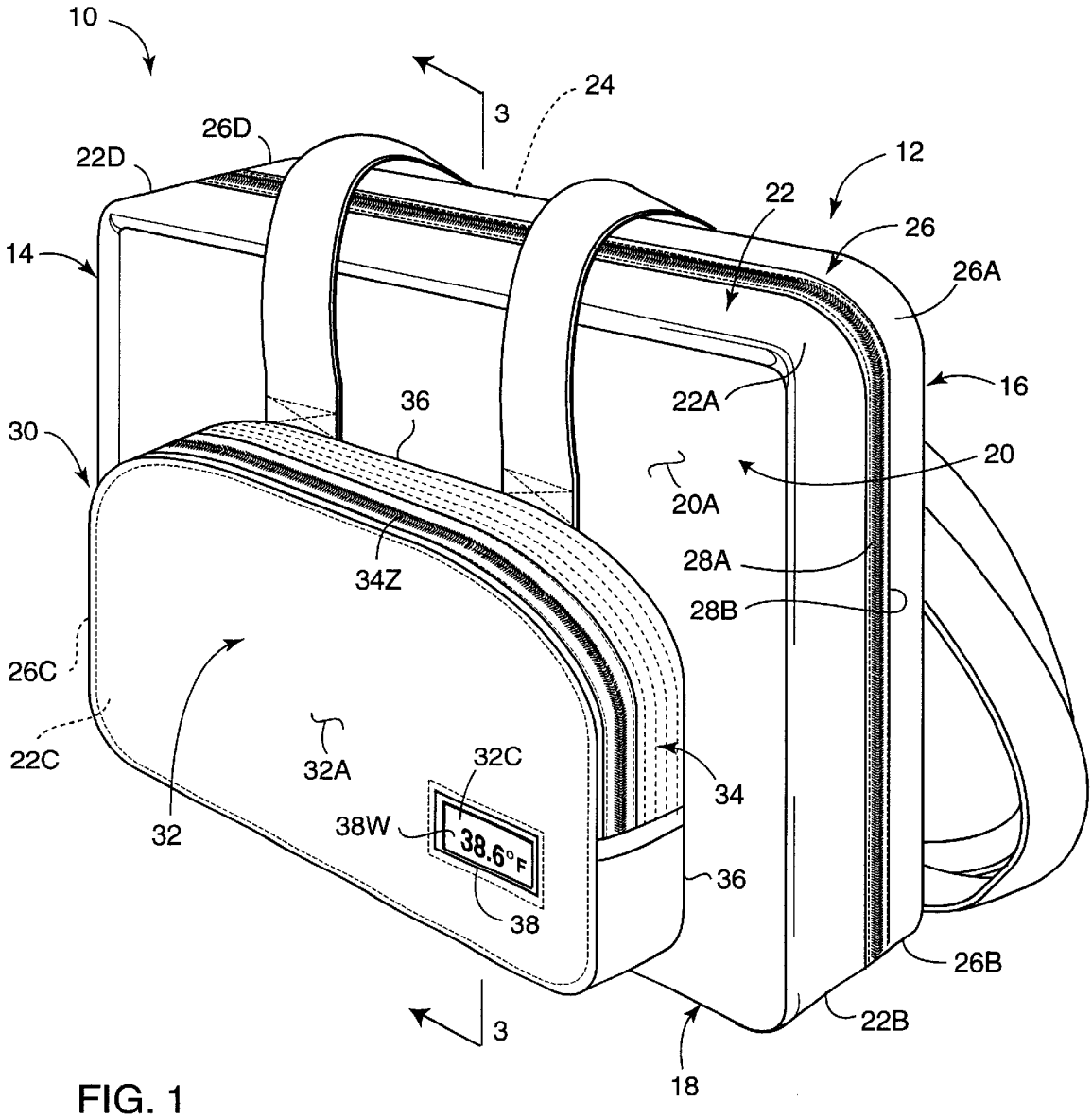
FIG. 1 is a perspective view of a first embodiment of a closed thermally insulated bag for transporting medications or other temperature-sensitive materials, having an exteriorly mounted LCD showing the temperature in the bag interior.

While the present invention is open to various modifications and alternative constructions, the preferred embodiment shown in the drawings will be described herein in detail. It is to be understood, however, there is no intention to limit the invention to the particular form disclosed. On the contrary, it is intended that the invention cover all modifications, equivalences and alternative constructions falling within the spirit and scope of the invention as expressed in the appended claims.

Where used herein, the word "attached" means that the two parts referred to are either fabricated in a single piece or are sewn or glued together. However, other forms of attachment may be suitable, consistent with simplicity of manufacture and reliability of operation. Where used herein, the words "connects", "connected" and "connecting" mean that the two parts referred to (e.g., an electrical cable and a temperature-sensing element) can be readily separated after being joined together.

Figure 3:
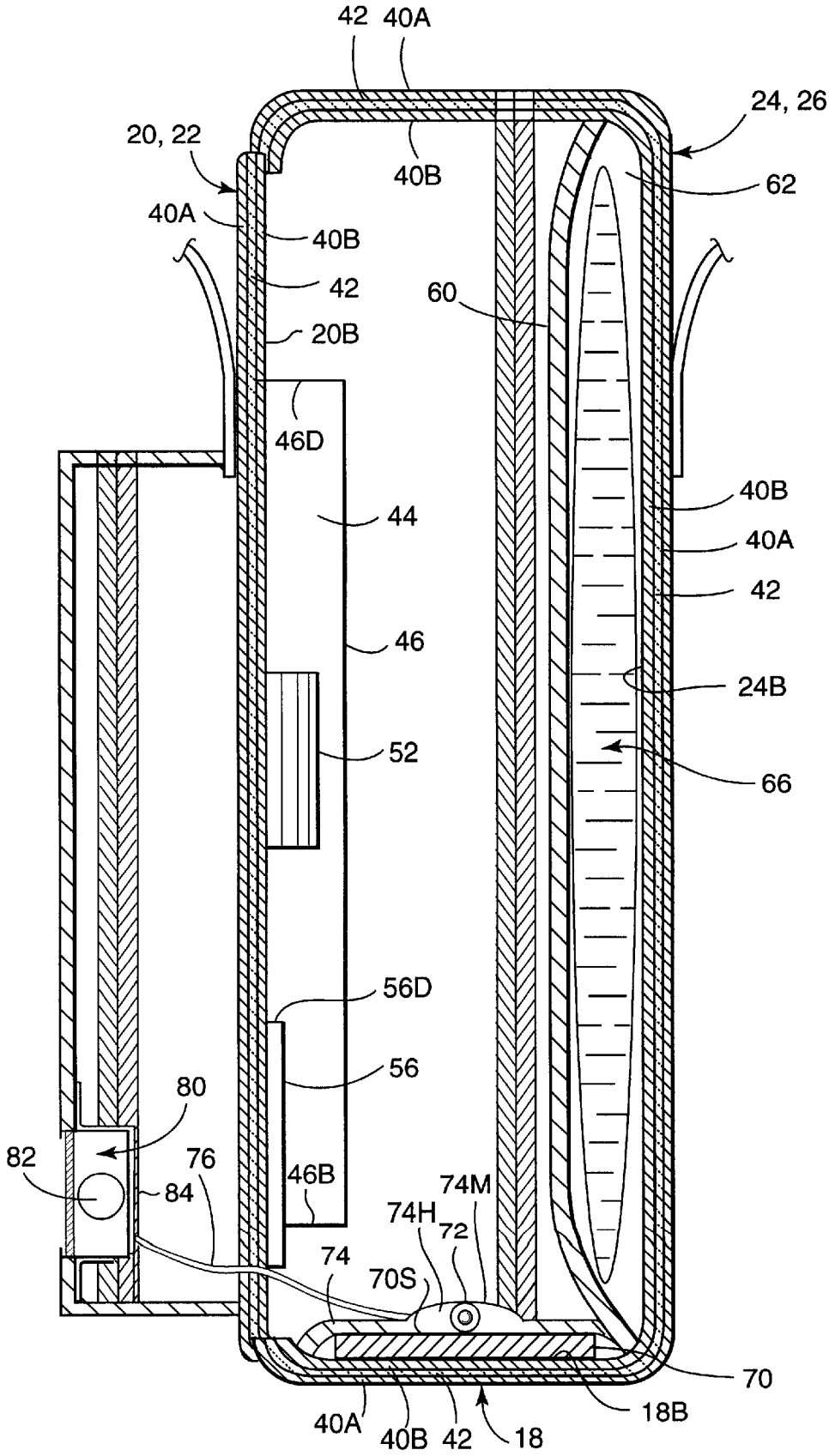
FIG. 3 is a cross-sectional view of the FIG. 1 bag taken along the line 3—3.

Referring to FIG. 1, a first embodiment of a traveling bag 10 according to the invention includes a generally rectangular case 12 having a front portion 14 and a back portion 16 pivotally attached to each other by a central portion 18. Case front portion 14 includes a front side 20, having a generally planar exterior surface 20A, generally orthogonal and attached to a U-shaped frame portion 22 having rounded edges 22A, 22B, 22C, 22D. Case back portion 16 includes a back side 24 generally orthogonal and attached to a U-shaped frame portion 26 having rounded edges 26A, 26B, 26C, 26D which coincide, respectively, with edges 22A, 22B, 22C, 22D. Frame portions 22 and 26 are attached by a wide-band zipper 28A–28B which opens and closes the case 12. The bag 10 further includes a pouch 30 having a front portion 32 generally orthogonal and attached to a circumferential frame portion 34 having a zipper 34Z and a circumferential edge 36 attached to surface 20A. Front portion 32 has an exterior surface 32A having a generally rectangular cutout 32C in which is disposed a liquid crystal display (LCD) 38 showing the temperature inside the case 12. A plastic window 38W centered over cutout 32C and attached to surface 32A protects the LCD 38. As shown in FIG. 3, sides 20 and 24, frame portions 22 and 26, and central portion 18 each have outer and inner layers of fabric 40A, 40B, respectively, between which is disposed a layer 42 of thermally insulative material. Preferably, layer 42 is ⅜-inch thick DACRON™.

Figure 2:
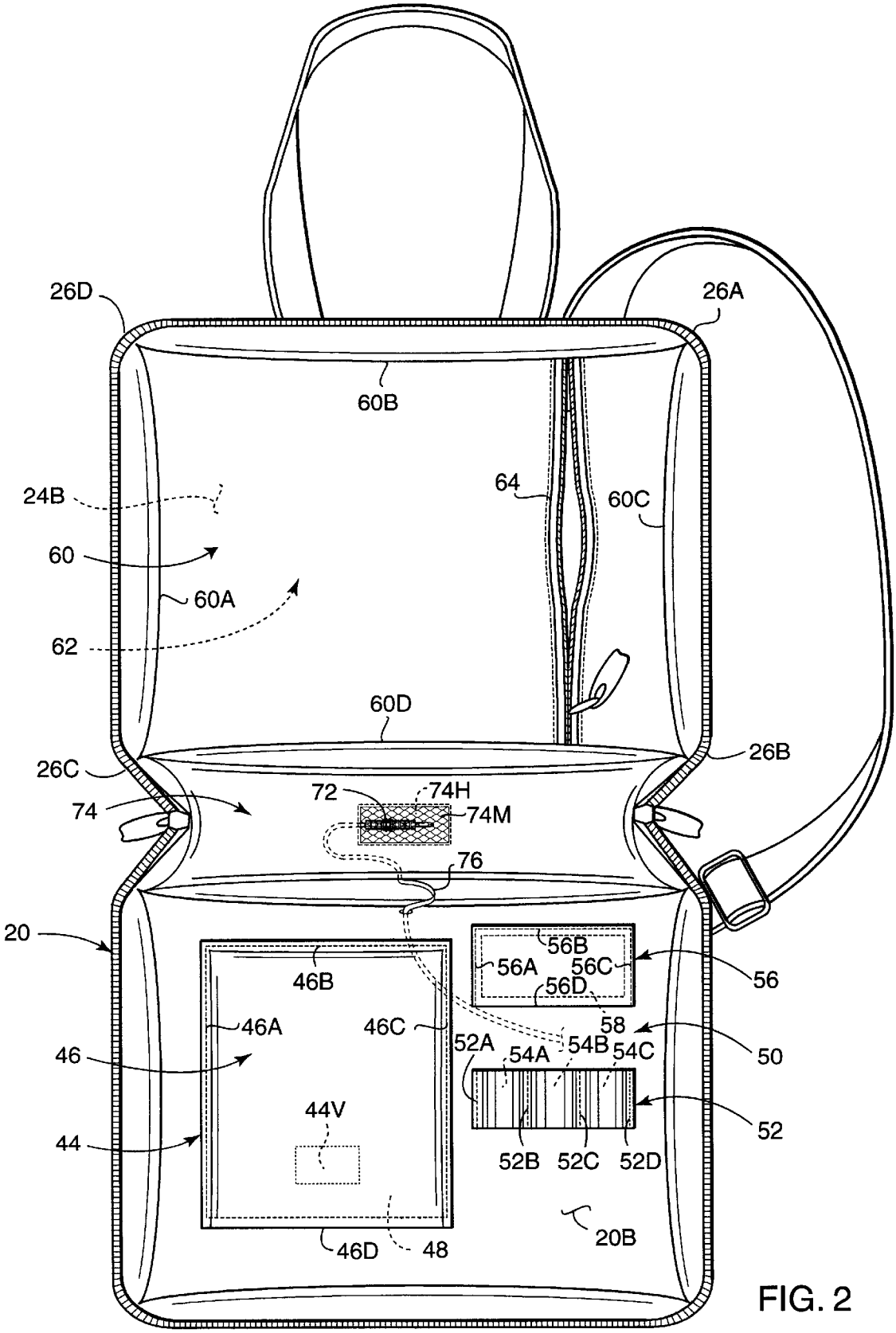
FIG. 2 is a top plan view of the open FIG. 1 bag showing a zippered compartment holding a container of freezing material, a temperature-sensing element mounted on a thermally insulating base, a cable connecting the element and FIG. 1 display, an expandable storage compartment, and a dual portion assembly for securely holding insulin pens.

Referring to FIGS. 2 and 3, case front side 20 has an interior surface 20B, which is a portion of the interior surface of fabric layer 40B, to which is attached an expandable storage compartment 44 determined by a generally rectangular fabric wall 46 having edges 46A, 46B, 46C sewn to surface 20B, and an unsewn edge 46D bounding an opening 48 closable with a VELCRO™ patch 44V. Also attached to surface 20B is an assembly 50 for securely holding insulin pens or the like including an elasticized fabric strap 52 sewn to surface 20B along lateral lines 52A, 52B, 52C, 52D, thereby determining open-ended receptacles 54A, 54B, 54C. Assembly 50 further includes a generally rectangular shield 56 having edges 56A, 56B, 56C sewn to surface 20B, and an unsewn edge 56D bounding an opening 58. Case back side 24 has an interior surface 24B, which also is a portion of the interior surface of fabric inner layer 40B, to which a generally rectangular moisture-proof fabric wall 60 is attached along edges 60A, 60B, 60C, 60D which meet at vertices proximate to frame portion edges 26A, 26B, 26C, 26D. Wall 60 and surface 24B determine a compartment 62, accessible by opening a zipper 64, which receives a substantially flat container of freezing material such as a gel refrigerant 66.

Still referring to FIGS. 2 and 3, central portion 18 has an interior surface 18B, which also is a portion of the interior surface of fabric inner layer 40B, to which is attached a base 70 of thermally insulative material having a generally planar upper surface 70S on which is rigidly mounted a temperature-sensing element 72. A fabric layer 74, having a generally rectangular cutout 74H with a mesh 74M superposed over element 72, covers the base 70. As shown in FIG. 3, an electrical cable 76 connects element 72 and a temperature gauge 80, powered by a battery 82, whose face is the LCD 38 protected by window 38W (see FIG. 1). Preferably, base 70 is polyisourethane, about 5/8-inch in thickness, manufactured by Celotex, Inc. of Tampa, Fla. Preferably, element 72 is a thermistor having a range from about −10° F. to about +130° F. As shown in FIG. 3, gauge 80 is covered with a VELCRO™ layer 84 so that articles or a hand inserted into pouch 30 cannot interfere with the gauge.

Figure 4:
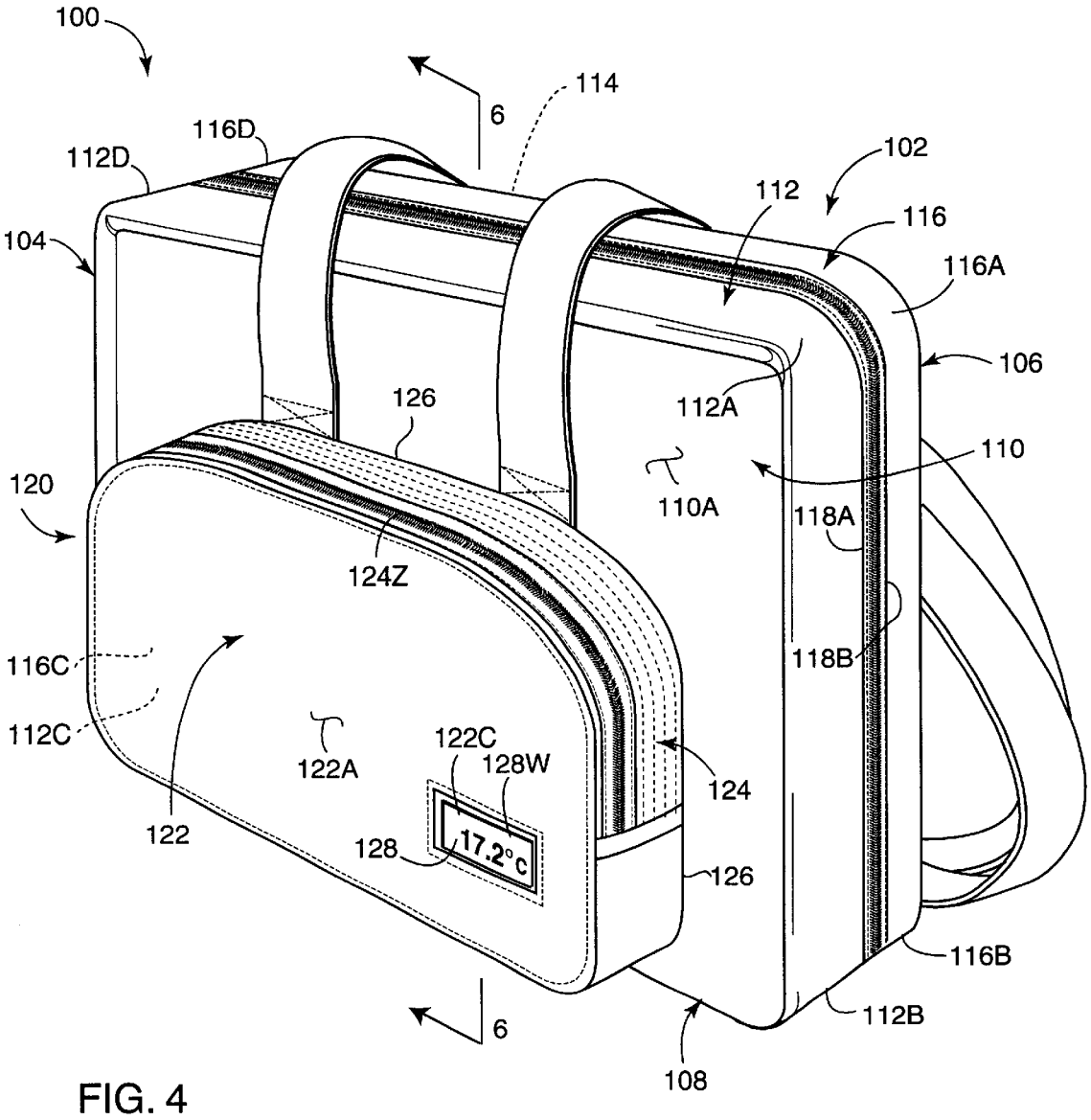
FIG. 4 is a perspective view of a second embodiment of a closed thermally insulated bag for transporting medications or other temperature-sensitive materials, having an externally mounted LCD showing the temperature in the bag interior.
Figure 6:
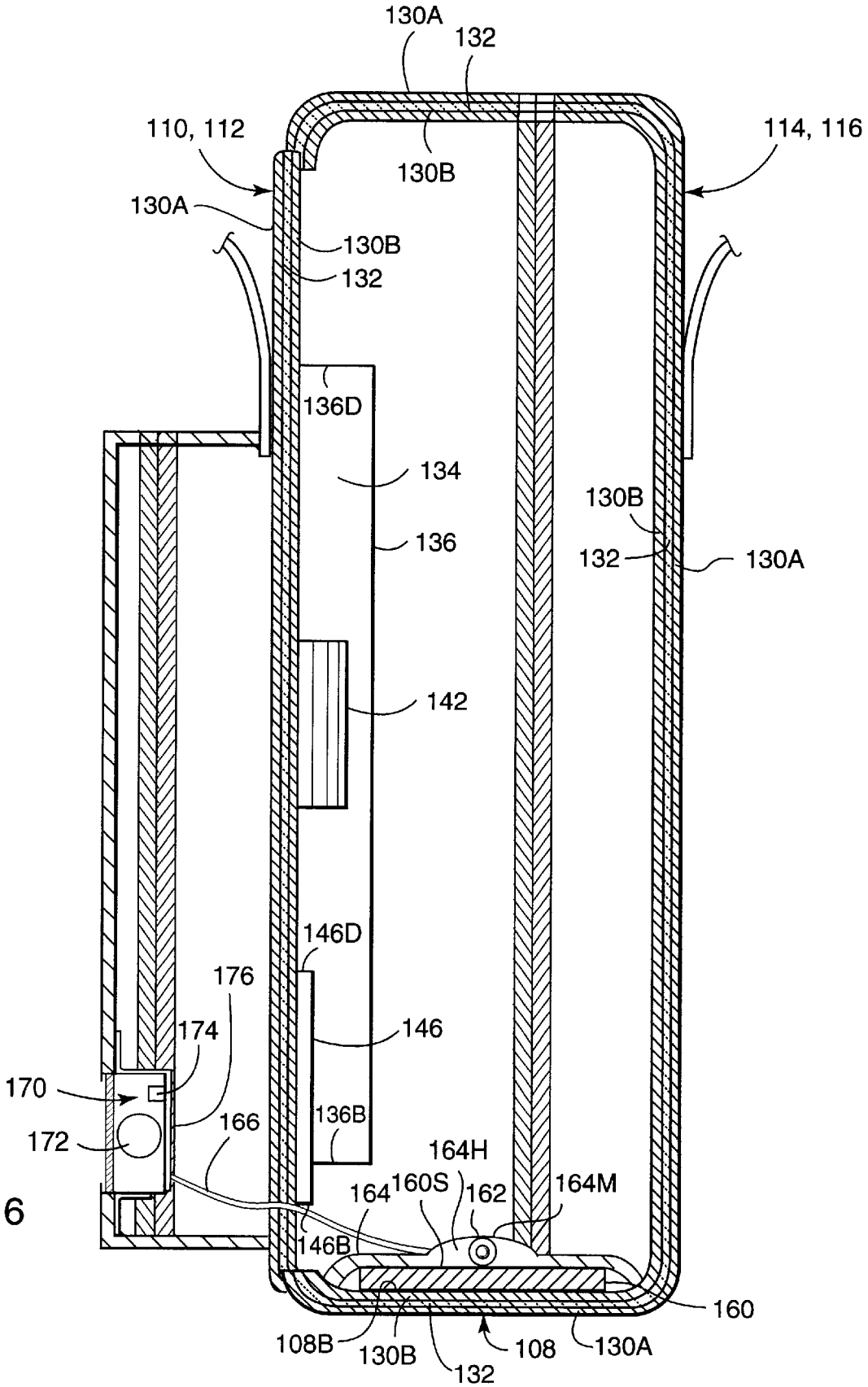
FIG. 6 is a cross-sectional view of the FIG. 4 bag taken along the line 6—6.

Referring to FIG. 4, a second embodiment of a traveling bag 100 according to the invention includes a generally rectangular case 102 having a front portion 104 and a back portion 106 pivotally attached to each other by a central portion 108. Case front portion 104 includes a front side 110, having a generally planar exterior surface 110A, generally orthogonal and attached to a U-shaped frame portion 112 having rounded edges 112A, 112B, 112C, 112D. Case back portion 106 includes a back side 114 generally orthogonal and attached to a U-shaped frame portion 116 having rounded edges 116A, 116B, 116C, 116D which coincide, respectively, with edges 112A, 112B, 112C, 112D. Frame portions 112 and 116 are attached by a wide-band zipper 118A–118B which opens and closes the case 102. The bag 100 further includes a pouch 120 having a front portion 122 generally orthogonal and attached to a circumferential frame portion 124 having a zipper 124Z and a circumferential edge 126 attached to surface 110A. Front portion 122 has an exterior surface 122A having a generally rectangular cutout 122C in which is disposed a LCD 128. A plastic window 128W centered over cutout 122C and attached to surface 122A protects the LCD 128. As shown in FIG. 6, sides 110 and 114, frame portions 112 and 116, and central portion 108 each have outer and inner layers of fabric 130A, 130B, respectively, between which is disposed a layer 132 of thermally insulative material. Preferably, layer 132 is ⅜-inch thick DACRON™.

Figure 5:
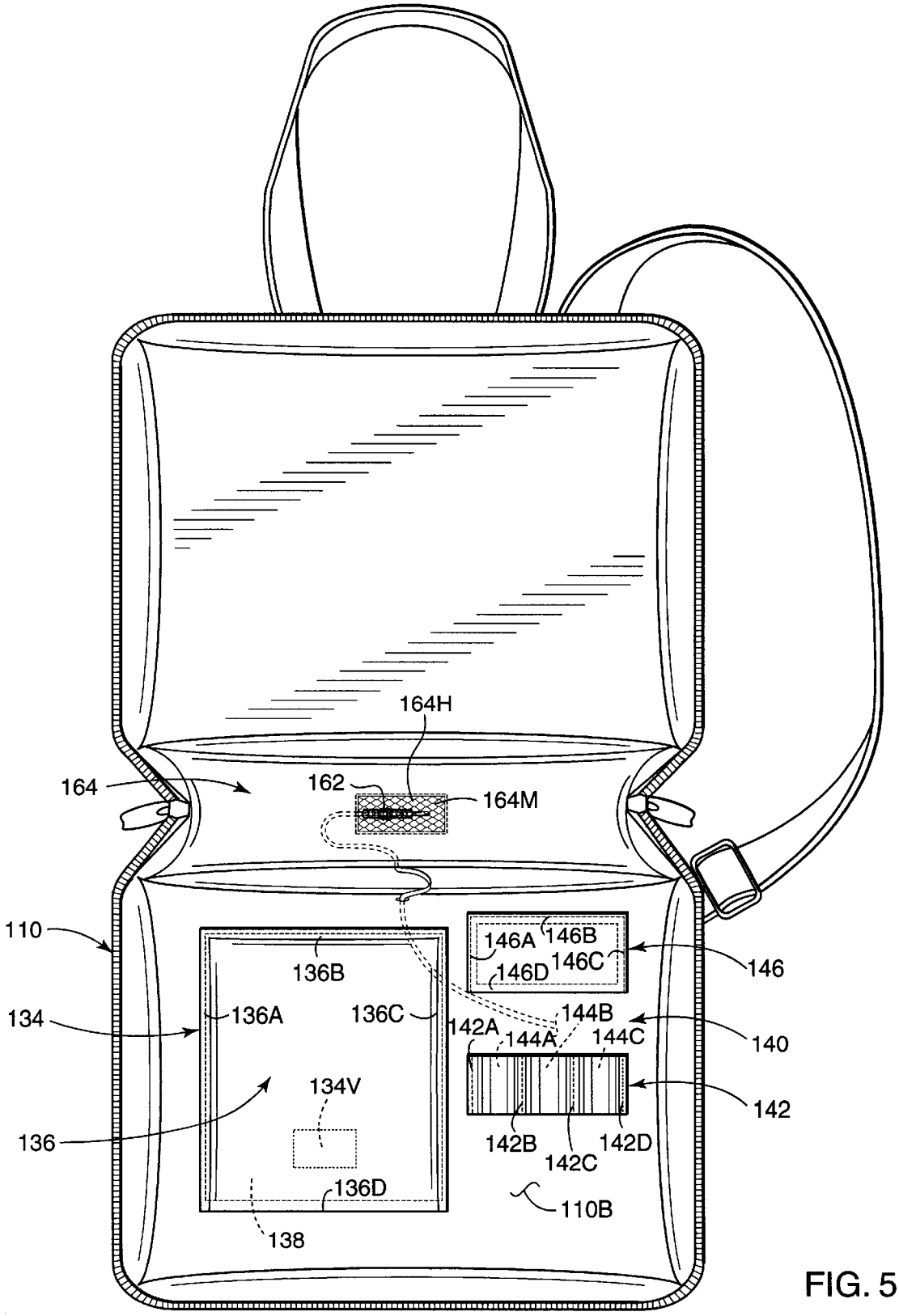
FIG. 5 is a top plan view of the open FIG. 4 bag showing a temperature-sensing element mounted on a thermally insulating base, a cable connecting the element and FIG. 4 display, an expandable storage compartment, and a dual portion assembly for securely holding insulin pens.

Referring to FIGS. 5 and 6, case front side 110 has an interior surface 110B, which is a portion of the interior surface of fabric layer 130B, to which is attached an expandable storage compartment 134 determined by a generally rectangular fabric wall 136 having edges 136A, 136B, 136C sewn to surface 110B, and an unsewn edge 136D bounding an opening 138 closable with a VELCROTM patch 134V. Also attached to surface 110B is an assembly 140 for securely holding insulin pens or the like including an elasticized fabric strap 142 sewn to surface 110B along lateral lines 142A, 142B, 142C, 142D, thereby determining open-ended receptacles 144A, 144B, 144C. Assembly 140 further includes a generally rectangular shield 146 having edges 146A, 146B, 146C sewn to surface 110B, and an unsewn edge 146D bounding an opening 148.

Still referring to FIGS. 5 and 6, central portion 108 has an interior surface 108B, which also is a portion of the interior surface of fabric inner layer 130B, to which is attached a base 160 of thermally insulative material having a generally planar upper surface 160S on which is rigidly mounted a temperature-sensing element 162. A fabric layer 164, having a generally rectangular cutout 164H with a mesh 164M superposed over element 162, covers the base 160. An electrical cable 166 connects element 162 and a temperature gauge 170, powered by a battery 172, whose face is the LCD 128 protected by window 128W (see FIG. 4). Gauge 170 includes a switch 174 allowing a user to select between a Fahrenheit or a Celsius reading on LCD 128. Preferably, base 160 is polyisourethane, about ⅝-inch in thickness. Preferably, element 162 is a thermistor. As shown in FIG. 6, gauge 170 is covered with a VELCRO™ layer 176 so that articles or a hand inserted into pouch 120 cannot interfere with the gauge, particularly with switch 174.

What is claimed is:

1. A traveling bag comprising:

a case having a thermally insulated front portion with a front side having an exterior surface, a thermally insulated back portion, and a thermally insulated central portion pivotally attached to said front and back portions so that the front and back portions are pivotal relative to each other between a closed position in which the front and back portions are generally parallel to each other, and an open position in which the front and back portions are pivoted away from each other, the case closable when said front and back portions are in the closed position by closing a zipper mutually attached to the front and back portions, the case when closed determining a thermally insulated interior cavity;

a pouch having a front portion with an exterior surface, said front portion generally orthogonal and attached to a circumferential frame portion having a circumferential edge attached to said exterior surface of the case front side;

a temperature-sensing element disposed within said cavity, said element quantitatively measuring the temperature within the cavity; and a temperature gauge which numerically displays said temperature, said gauge in electrical communication with said temperature-sensing element, said gauge comprising a numerical display mounted at a preselected exterior portion of the bag.

2. The traveling bag of claim 1, wherein:

said temperature-sensing element is a thermistor rigidly mounted on a base of thermally insulative material; and said numerical display is a liquid crystal display mounted at the exterior surface of the pouch front portion.

3. A traveling bag comprising:

a generally rectangular case comprising a thermally insulated front portion having a front side with a generally planar exterior surface and a generally planar interior surface, the front side generally orthogonal and attached to a first U-shaped frame portion, the case further comprising a thermally insulated back portion having a back side with a generally planar interior surface, the back side generally orthogonal and attached to a second U-shaped frame portion, the case further comprising a thermally insulated central portion with a generally planar interior surface, the central portion pivotally attached to said first and second frame portions so that said front and back portions are pivotal relative to each other between a closed position in which the front and back portions are generally parallel to each other, and an open position in which the front and back portions are pivoted away from each other, the case closable when said front and back portions are in the closed position by closing a zipper mutually attached to the first and second frame portions, the case when closed determining a thermally insulated interior cavity;

a pouch having a front portion with an exterior surface, said front portion generally orthogonal and attached to a circumferential frame portion having a circumferential edge attached to said exterior surface of the case front side, the exterior surface of said front portion having a generally rectangular cutout wherein is disposed a liquid crystal numerical display of a temperature gauge disposed within the pouch;

a temperature-sensing element rigidly mounted on a generally planar upper surface of a base of thermally insulative material, the base attached to said central portion interior surface, the element quantitatively measuring the temperature within said cavity, the element in electrical communication with the temperature gauge;

an expandable compartment determined by a generally rectangular wall having three edges attached to said interior surface of the case front side and a fourth unattached edge bounding a closable opening;

an assembly comprising an elasticized strap attached along a first plurality of generally parallel lines to said interior surface of the case front side so as to determine a second plurality of open-ended receptacles, the assembly further comprising a generally rectangular shield having three edges attached to said interior surface of the case front side and a fourth unattached edge bounding an opening proximate and generally parallel to said receptacles; and a compartment for receiving a substantially flat container of freezing material determined by a generally rectangular wall attached along four edges to said interior surface of the case back side, the compartment accessible by opening a zipper in the wall.

4. The traveling bag of claim 3 wherein said temperature-sensing element is a thermistor, and said base of insulative material is polyisourethane, about ⅝-inch in thickness.

5. A traveling bag comprising:

a generally rectangular case comprising a thermally insulated front portion having a front side with a generally planar exterior surface and a generally planar interior surface, the front side generally orthogonal and attached to a first U-shaped frame portion, the case further comprising a thermally insulated back portion having a back side with a generally planar interior surface, the back side generally orthogonal and attached to a second U-shaped frame portion, the case further comprising a thermally insulated central portion with a generally planar interior surface, the central portion pivotally attached to said first and second frame portions so that said front and back portions are pivotal relative to each other between a closed position in which the front and back portions are generally parallel to each other, and an open position in which the front and back portions are pivoted away from each other, the case closable when said front and back portions are in the closed position by closing a zipper mutually attached to the first and second frame portions, the case when closed determining a thermally insulated interior cavity;

a pouch having a front portion with an exterior surface, said front portion generally orthogonal and attached to a circumferential frame portion having a circumferential edge attached to said exterior surface of the case front side, the exterior surface of said front portion having a generally rectangular cutout wherein is disposed a liquid crystal display of a temperature gauge disposed within the pouch, the gauge switchable between the Fahrenheit and Celsius scales;

a temperature-sensing element rigidly mounted on a generally planar upper surface of a base of thermally insulative material, the base attached to said central portion interior surface, the element in electrical communication with the temperature gauge;

an expandable compartment determined by a generally rectangular wall having three edges attached to said interior surface of the case front side and a fourth unattached edge bounding a closable opening; and an assembly comprising an elasticized strap attached along a first plurality of generally parallel lines to said interior surface of the case front side so as to determine a second plurality of open-ended receptacles, the assembly further comprising a generally rectangular shield having three edges attached to said interior surface of the case front side and a fourth unattached edge bounding an opening proximate and generally parallel to said receptacles.

6. The traveling bag of claim 5 wherein said temperature-sensing element is a thermistor, and said base of insulative material is polyisourethane, about ⅝-inch in thickness.

* * * * *